United States Patent [19]

Leveskis

[11] Patent Number: 4,470,920

[45] Date of Patent: Sep. 11, 1984

[54] METAL OXIDE REMOVER FOR STAINLESS STEELS

[75] Inventor: Newton G. Leveskis, Auburn, Calif.

[73] Assignee: Custom Research and Development, Auburn, Calif.

[21] Appl. No.: 515,881

[22] Filed: Jul. 19, 1983

Related U.S. Application Data

[63] Continuation of Ser. No. 262,076, May 11, 1981, abandoned.

[51] Int. Cl.[3] ..... C11D 7/08; C11D 7/26; C11D 7/32; C23G 1/08

[52] U.S. Cl. ..... 252/142; 134/3; 252/80; 252/87; 252/546

[58] Field of Search ..... 252/80, 87, 142; 184/3; 156/664, 903

[56] References Cited

U.S. PATENT DOCUMENTS

| | | | |
|---|---|---|---|
| 2,220,451 | 11/1940 | Hunt | 252/142 |
| 3,025,189 | 3/1962 | Arden | 134/3 |
| 3,072,515 | 1/1963 | Smolinski et al. | 156/20 |
| 3,121,026 | 2/1964 | Beigay et al. | 134/2 |
| 3,230,172 | 1/1966 | Gasperini | 252/101 |
| 3,349,036 | 10/1967 | Campbell | 156/665 X |
| 3,367,874 | 2/1968 | Haviland | 252/79.2 |
| 3,457,107 | 7/1969 | Mickelson et al. | 134/3 |
| 3,496,017 | 2/1970 | Weed | 134/2 |
| 3,529,998 | 9/1970 | Singer | 134/1 |
| 3,573,984 | 4/1971 | Shah | 134/2 |
| 3,600,316 | 8/1971 | Mostecky et al. | 252/80 |
| 3,627,687 | 12/1971 | Teumac et al. | 252/80 |
| 3,709,824 | 1/1973 | Oda et al. | 252/142 |
| 3,909,437 | 9/1975 | Alexander | 252/143 |
| 4,174,290 | 11/1979 | Leveskis | 252/142 |
| 4,250,048 | 2/1981 | Leveskis | 252/142 |
| 4,282,041 | 8/1981 | Cork | 252/101 |

FOREIGN PATENT DOCUMENTS

| | | | |
|---|---|---|---|
| 637893 | 3/1962 | Canada | 252/142 |
| 1483146 | 6/1967 | France | 252/142 |
| 896159 | 5/1962 | United Kingdom | 252/142 |

*Primary Examiner*—Dennis L. Albrecht

*Attorney, Agent, or Firm*—Townsend and Townsend

[57] ABSTRACT

A composition for removing metal oxides from stainless steel is disclosed. The composition is an aqueous solution of nitric acid, sulfamic acid and a chelating agent selected from a group comprising amino acids and hydroxy acids. The solution should be applied at an elevated temperature.

3 Claims, No Drawings

METAL OXIDE REMOVER FOR STAINLESS STEELS

This is a continuation of application Ser. No. 262,076, filed May 11, 1981, now abandoned.

BACKGROUND OF THE INVENTION

1. Field of the Invention

This invention relates generally to a composition for cleaning stainless steel. More particularly, the invention relates to the removal of metal oxides while avoiding discoloration of the metal.

2. Description of the Prior Art

It is known to treat stainless steel with a combination of nitric acid and a hydroxy acid to remove heat scale therefrom. See, U.S. Pat. No. 3,025,189. The method disclosed therein requires that the metal be pretreated in an alkaline bath to achieve adequate cleaning.

Other references include the following: U.S. Pat. Nos. 3,072,515; 3,121,026; 3,230,172; 3,457,107; 3,496,017; 3,529,998; 3,573,984; 3,600,316; 3,627,687; 3,709,824; 4,174,290; and 4,250,048.

SUMMARY OF THE INVENTION

The present invention provides a composition which leaves a stainless steel surface substantially free of metal oxides and substantially free of discoloration such as the streaking condition associated with various of the prior art formulations. It is preferred to apply the cleaning composition at an elevated temperature.

This is accomplished with an aqueous solution containing sulfamic acid, nitric acid and a chelating agent selected from the group comprising hydroxy acids and amino acids. With a hydroxy acid as the chelating agent, it is preferred to combine at least one part by weight sulfamic acid, approximately 10 parts by weight hydroxy acid, and approximately ten parts by weight concentrated nitric acid together and 120 parts by weight water. With an amino acid as the chelating agent, it is preferred to combine at least one part by weight amino acid, at least two parts by weight sulfamic acid and approximately 20 parts by weight concentrated nitric acid together and 240 parts by weight of water.

The preferred hydroxy acids are tartaric acid, malic acid, gluconic acid, ascorbic acid, and lactic acid. The preferred amino acids are lysine, glutamic acid, and DL-alanine.

It will be appreciated that the components used will form ions in aqueous solution. Accordingly, equivalent results can be obtained by addition of the various components as salts which form the desired ions. For example, a citrate salt could be used to supply part of the citric acid.

DESCRIPTION OF THE PREFERRED EMBODIMENT

Two closely related formulations have been found effective in removing metal oxide scale from stainless steel under the conditions described in reference to the examples hereinafter. These formulations are as follows:

| | AMINO ACID FORMULA | |
|---|---|---|
| Component | Effective Range* | Preferred Range* |
| Water | 240 | 240 |

-continued

| | AMINO ACID FORMULA | |
|---|---|---|
| Component | Effective Range* | Preferred Range* |
| Concentrated nitric acid | 5–50 | 10–30 |
| Sulfamic acid | 1–50 | 2–5 |
| Amino acid | 1–50 | 2–5 |

*parts by weight

| | HYDROXY ACID FORMULA | |
|---|---|---|
| Component | Effective Range* | Preferred Range* |
| Water | 240 | 240 |
| Concentrated nitric acid | 5–50 | 10–30 |
| Sulfamic acid | 1–50 | 2–10 |
| Hydroxy acid | 10–50 | 20–40 |

*parts by weight

For rapid removal of scale, it is desirable to employ the cleaning solution at an elevated temperature, for example at about 120°–212° F. to shorten treatment time.

Referring now to Table 1, a series of tests were run to confirm the efficacy of both the amino acid formula and the hydroxy acid formula in removing metal oxide scale from stainless steel. Samples of 302 stainless steel approximately 0.2 inches in diameter and 5 inches long and coated with metal oxide forming a dark coloration on the surface thereof were exposed to the above formulae, as well as to various comparison formulae, in test tubes at 185° F. to 190° F. for periods of thirty minutes. The samples were then washed in running water and evaluated. In each case, the components of the solution were mixed in 60 ml of water.

TABLE I

| Test No. | Conc. Nitric Acid (ml) | Sufamic Acid (gm) | Hydroxy Acid (gm) | Amino Acid (gm) |
|---|---|---|---|---|
| 1 | 8 | 5 | 5-citric | 0 |
| 2 | 8 | 5 | 5-tartaric | 0 |
| 3 | 8 | 5 | 5-malic | 0 |
| 4 | 8 | 5 | 5-gluconic | 0 |
| 5 | 8 | 5 | 5-ascorbic | 0 |
| 6 | 8 | 5 | 5-lactic | 0 |
| 7 | 8 | 5 | 0 | 5-Lysine |
| 8 | 8 | 5 | 0 | 5-Glutamic |
| 9 | 8 | 5 | 0 | 5 DL-Alanine |
| 10 | 8 | 5 | 0 | 0 |
| 11 | 8 | 5 | 0 | 0 |
| 12 | 8 | 0 | 0 | 0 |
| 13* | 0 | 0 | 7-Malic | 0 |
| 14 | 0 | 0 | 0 | 0 |

| Test No. | Other Component (gm) | Results |
|---|---|---|
| 1 | 0 | Clean, No Oxide Remaining |
| 2 | 0 | Clean, No Oxide Remaining |
| 3 | 0 | Clean, No Oxide Remaining |
| 4 | 0 | Clean, No Oxide Remaining |
| 5 | 0 | Clean, No Oxide Remaining |
| 6 | 0 | Clean, No Oxide Remaining |
| 7 | 0 | Clean, No Oxide Remaining |
| 8 | 0 | Clean, No Oxide Remaining |
| 9 | 0 | Clean, No Oxide Remaining |
| 10 | 5-Malonic Acid | Streaks of Oxide Remaining |
| 11 | 0 | Streaks of Oxide Remaining |
| 12 | 0 | Little Oxide Removed |
| 13* | 3-Hyamine 3500 | Little Oxide Removed |

TABLE I-continued

| | | |
|---|---|---|
| 14 | 0 | No Oxide Removed |

*pH adjusted to 0.8 with HCl

In tests nos. 1–6, a series of hydroxy acids were each mixed with 5 grams of sulfamic acid and eight ml of concentrated nitric acid, as shown. A hydroxy acid is an acid including at least one carboxyl group and at least one hydroxyl group, having the general formula HO-R-$CO_2H$, where R is a saturated or unsaturated aliphatic chain which may include additional hydroxyl and carboxyl groups. Hydroxy acids having 10 or fewer carbon atoms and 10 or fewer hydroxyl groups are effective in the formulation of the present invention, with the preferred hydroxy acid having 3–6 carbon atoms and 2–6 hydroxyl groups. In each of these tests, the sample was completely cleaned with no oxide or other discoloration remaining.

In tests nos. 7–9, a series of three amino acids was tested. An amino acid is an acid having the formula $NH_2$-R-$CO_2H$, where "R" is typically a saturated aliphatic radical which may include additional carboxyl and amino side groups. Amino acids having 10 or fewer carbon atoms are effective in the formulation of the present invention, with the preferred amino acid having 3–6 carbon atoms. Each of the amino acids tested performed satisfactorily, removing all oxide and discoloration from the surface of the stainless steel.

In test no. 10, malonic acid, which is neither a hydroxy acid nor an amino acid, was substituted as the chelating agent. Specifically, 5 grams of malonic acid was combined with 5 grams of sulfamic acid and 8 ml of concentrated nitric acid. While much of the oxide was removed, longitudinal strips of metal oxide remained on the sample, leaving a visible discoloration.

In test no. 11 an aqueous solution of five grams of sulfamic acid and 8 ml of concentrated nitric acid was used without the addition of any additional component. The result was quite similar to that of test no. 10, much of the oxide being removed with longitudinal strips of oxide discoloration remaining.

In test no. 12, an aqueous solution of nitric acid alone was tested. Such a solution removed very little oxide from the sample.

Test no. 13 utilized an aqueous solution containing seven grams of malic acid and three grams of Hyamine 3500, which is a mixture of ethyl alcohol and N-alkyldimethylbenzolammoniumchloride, manufactured by the Rohm & Haas Company. Such a formulation was found to remove rust and scale from carbon steel as disclosed in U.S. Pat. No. 4,250,048. The formulation was ineffective in removing oxide scale from stainless steel.

Test no. 14 was a control where the sample was exposed to pure water. No oxide was observed to be removed.

While the above tests were conducted on 302 stainless steel as a sample, both the hydroxy acid formula and the amino acid formula were also tested on samples of 304, 316 and 400 series stainless steels. The formulations were able to remove metal oxide scale from each of these types of stainless steel with comparable efficacy to that observed with series 302 stainless steel.

Referring now to Table II, the effect of varying the sulfamic acid concentration in the hydroxy acid formula can be observed. Five solutions were prepared having 60 ml of water, 5 grams of citric acid, 8 ml of concentrated nitric acid and a variable amount of sulfamic acid. With 0.25 grams of sulfamic acid, much of the metal oxide scale was removed from a sample of stainless steel (test no. 1). By increasing the amount of sulfamic acid to 0.5 grams, even more metal oxide was removed from the sample (test no. 2). At concentrations of 5 grams and above, the stainless steel sample was entirely cleaned with no metal oxide remaining (tests nos. 3–5).

TABLE II*

| Test No. | Sulfamic Acid (gm) | Results |
|---|---|---|
| 1 | 0.25 | Streaks of Oxide Remaining |
| 2 | 0.5 | Little Oxide Remaining |
| 3 | 5 | Clean, No Oxide Remaining |
| 4 | 7 | Clean, No Oxide Remaining |
| 5 | 10 | Clean, No Oxide Remaining |

*These tests were conducted at a temperature of 190° F. for a period of one hour.

In Table III the effect of varying the concentration of the amino acid in the amino acid formulation can be observed. Five solutions were prepared, each having 60 ml of water, 4 ml of concentrated nitric acid, 5 grams of sulfamic acid and a variable amount of lysine. The amount of lysine varied from 0.25 grams to 10 grams and in each case it was observed that the 302 stainless steel sample was completely cleaned. This result may be compared to test no. 11 in Table I, where a sample having both the concentrated nitric acid and the sulfamic acid but no amino acid, left streaks of oxide remaining. Thus, it appears that a low threshold amount of amino acid chelating agent is necessary for successful results with the present invention. The presence of such a chelating agent, however, is absolutely necessary.

TABLE III*

| Test No. | Lysine (gm) | Results |
|---|---|---|
| 1 | 0.25 | Clean, No Oxide Remaining |
| 2 | 1 | Clean, No Oxide Remaining |
| 3 | 5 | Clean, No Oxide Remaining |
| 4 | 7 | Clean, No Oxide Remaining |
| 5 | 10 | Clean, No Oxide Remaining |

*These tests were conducted at a temperature of 190° F. for a period of one hour.

Although the best mode contemplated for carrying out the present invention has been herein shown and described, it will be apparent that variation and modification may be made without departing from what is regarded to be the subject matter of the present invention.

What is claimed is:

1. A method for removing metal oxide from stainless steel, said method comprising contacting the stainless steel with a composition comprising an aqueous solution containing from approximately two to five parts by weight amino acid as a chelating agent, from approximately two to five parts by weight sulfamic acid, and from approximately ten to thirty parts by weight concentrated nitric acid, all of said components being present in 240 parts by weight water.

2. A method for removing metal oxide from stainless steel, said method comprising contacting the stainless steel with a composition comprising an aqueous solution containing from approximately two to ten parts by weight sulfamic acid, as a chelating agent, from approximately twenty to forty parts by weight hydroxy acid, and from approximately ten to thirty parts by weight concentrated nitric acid, all of said components being present in 240 parts by weight water.

3. A method for removing metal oxide from stainless steel as in claims 1 or 2, wherein said contact is executed at an elevated temperature in the range from approximately 120° to 212° F.

* * * * *